US005586789A

United States Patent [19]

Bently

[11] Patent Number: 5,586,789

[45] Date of Patent: Dec. 24, 1996

[54] QUICK CONNECTOR FOR JOINING LARGE DIAMETER VACUUM HOSE TO DUCTWORK

[76] Inventor: John F. Bently, 11153 S. Wilton River Rd., New Richland, Minn. 56072

[21] Appl. No.: 496,602

[22] Filed: Jun. 29, 1995

[51] Int. Cl.[6] ..... F16L 35/00

[52] U.S. Cl. ..... 285/38; 285/158; 285/205; 285/312

[58] Field of Search ..... 285/38, 205, 210, 285/189, 420, 421, 312, 158, 312; 141/382–386

[56] References Cited

U.S. PATENT DOCUMENTS

| | | | |
|---|---|---|---|
| 998,352 | 7/1911 | Kublin | 141/383 X |
| 1,657,013 | 1/1928 | Kettle | 285/205 X |
| 2,495,754 | 1/1950 | Nance | 285/205 X |
| 4,504,085 | 3/1985 | Sachleben | 285/38 X |
| 4,844,859 | 7/1989 | Coussau | 285/210 X |

*Primary Examiner*—Dave W. Arola

[57] ABSTRACT

A quick connector assembly for temporarily connecting large diameter vacuum hose to heating, ventilating and air conditioning ductwork for the purpose of, but not limited to, establishing a vacuum within ductwork to aid in cleaning unwanted debris and materials from the ductwork. The quick connector assembly requires that a hole be cut into the ductwork. A large diameter vacuum hose is secured to a hose attachment tube on the present quick connector assembly. The quick connector assembly includes a flat circular flange which engages the duct wall when the quick connector assembly is held up to the hole. At least two pivoting support ears are pivoted outward until they extend beyond the edges of the cut hole. As they are pivoted outward, the pivoting support ears engage the inner side of the duct wall so that a clamping effect is created between the pivoting support ears and the flat circular flange, thus securing the quick connector assembly to the ductwork.

2 Claims, 4 Drawing Sheets

QUICK CONNECTOR FOR JOINING LARGE DIAMETER VACUUM HOSE TO DUCTWORK

BACKGROUND—FIELD OF INVENTION

The present invention is a means for temporarily connecting large diameter vacuum hose to ductwork, for the purpose of, but not limited to, establishing a vacuum within the ductwork during duct cleaning operations.

BACKGROUND OF THE INVENTION

There are many commercial air duct cleaners doing business in the United States who temporarily connect large diameter (about 4 to 15 inches or larger) vacuum hose to ductwork, especially ductwork associated with heating, ventilation and air conditioning (hvac) systems. Large diameter vacuum hose is used to connect vacuum and cleaning machines to ductwork to establish a vacuum within the ductwork, thus helping remove unwanted debris. There are numerous difficulties which arise while trying to connect flexible vacuum hose to HVAC ductwork. The present invention is designed to help make temporarily connecting large diameter vacuum hose to ductwork fast and simple.

DESCRIPTION OF PRIOR ART

Means previously developed and currently being used for connecting large diameter vacuum hose to HVAC ductwork generally require the use of equipment, such as screws, screwdrivers, and locking pliers or the use of tape, such as duct tape, to attach large diameter vacuum hose to ductwork. Screws and tape take time to affix and may work loose during cleaning. Previously developed ways of connecting large diameter vacuum hose to ductwork also often require that an end of the large diameter vacuum hose be inserted from 1 to 3 inches into ductwork. Inserting the hose into ductwork disrupts the smooth flow of air from the ductwork to the large diameter vacuum hose and allows debris to become trapped around the base of the vacuum hose, thus making the cleaning process less efficient. Means previously developed and currently being used, since they often require the use of screws or tape, are also time consuming to disconnect from ductwork, and may require that small tools and pieces of equipment be kept track of from one use to the next.

SUMMARY OF THE INVENTION

The principle object of the present invention is to provide a means whereby a quick, simple, strong temporary connection can be made between ductwork including but not limited to HVAC ductwork and large diameter flexible vacuum hose. It is also an object of the present invention to smooth the flow of air during cleaning from ductwork to large diameter flexible vacuum hose by eliminating the insertion of hose material into ductwork. It is a further object of the present invention to simplify disconnection by providing a connection means which does not require screws, clamps or tape, and which does not have small loose parts which may work loose during use or become misplaced or lost during transport or storage.

The foregoing objectives are achieved with a connection means which requires that a circular hole of appropriate diameter be cut into ductwork. Large diameter vacuum hose is secured around a hose attachment tube base of the connection means, so that the connection means is firmly attached to an end of a large diameter vacuum hose. Once the connection means is attached to a large diameter vacuum hose, the connection means is held up to the hole cut in the ductwork. At least one pivoting support ear is pivoted outward until it extends beyond the edges of the cut hole. As they are pivoted outward, the pivoting support ears tighten down toward a flat circular flange, thus clamping around the edges of the hole, and thus securing the connection means and the attached large diameter vacuum hose to the ductwork.

DETAILED DESCRIPTION OF PREFERRED EMBODIMENTS

Figure 1:
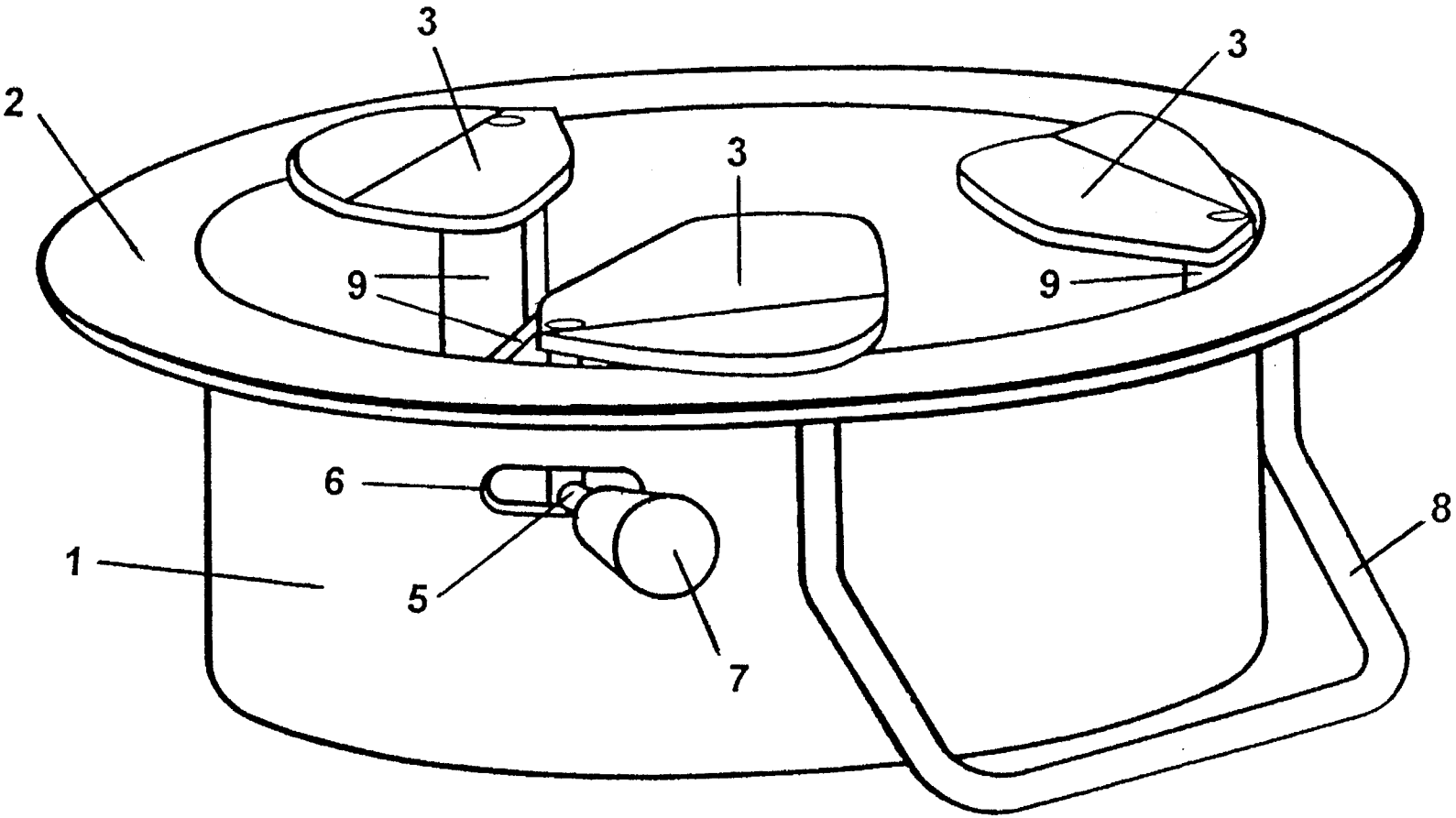
FIG. 1 shows an embodiment of the present invention with three pivoting support ears set in initial position.

FIG. 1 shows an embodiment of the present invention with pivoting support ears 3 set in initial position. The pivoting support ears 3 are mounted on pivoting rod assemblies 5, to which knobs 7 may be attached. Oval holes 6 allow the pivoting rod assembly 5 to extend from the pivot rod housing 9 through the hose attachment tube 1 to the knob 7. A flat circular flange 2 is mounted at the top of the hose attachment tube 1. At least one handle 8 may be attached to the exterior surface of the hose attachment tube 1. Pivot rod housings 9 are mounted on the interior surface of the hose attachment tube 1 and cover the interior workings of the pivoting rod assemblies 5.

Figure 2:
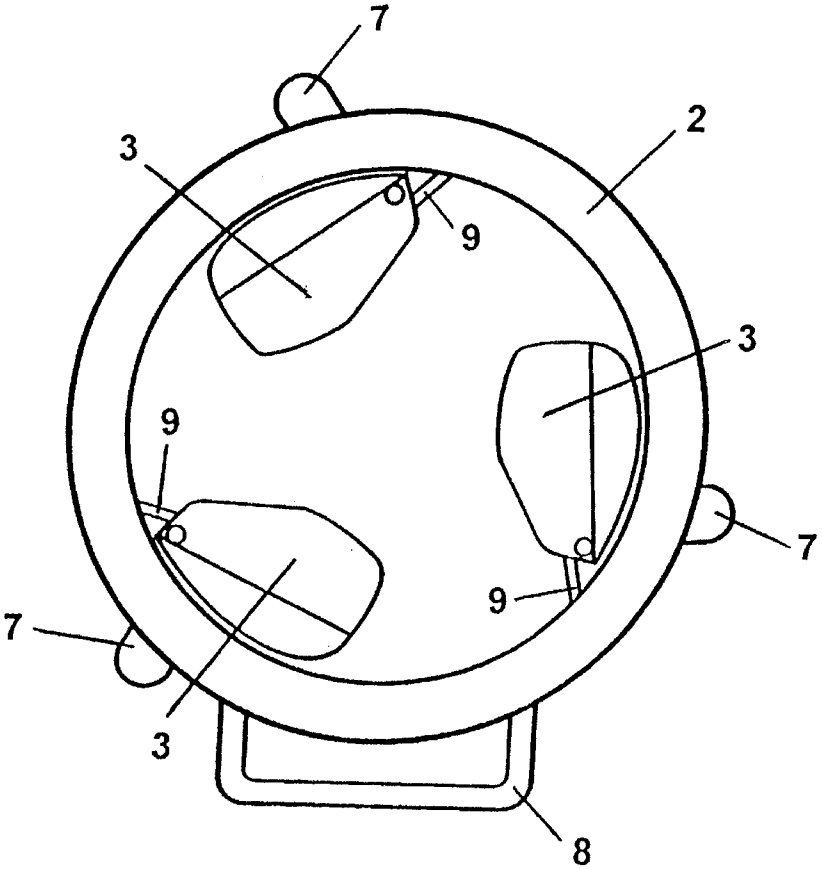
FIG. 2 shows a top view of an embodiment of the present invention with three pivoting support ears set in initial position.

FIG. 2 shows an embodiment similar to that in FIG. 1 from a top view.

Figure 3:
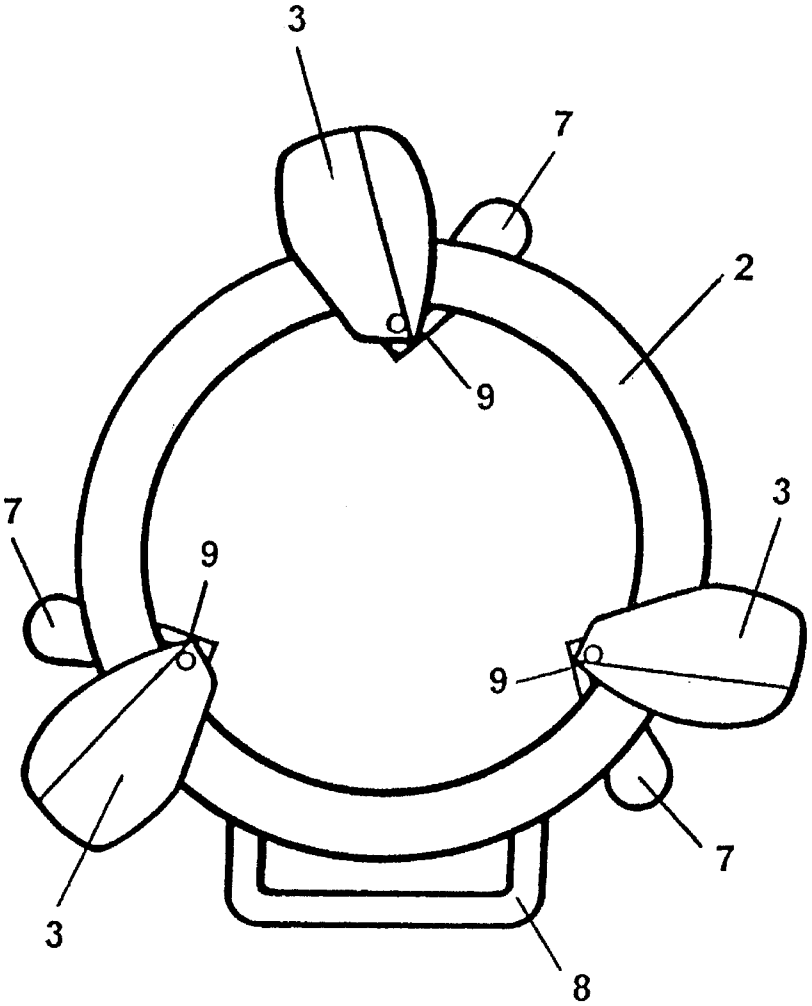
FIG. 3 shows a top view of an embodiment of the present invention with three pivoting support ears set in clamping position.

FIG. 3 shows another top view of the same embodiment with the pivoting support ears 3 and pivoting rod assemblies 5 and knobs 7 set in clamping position.

Figure 4:
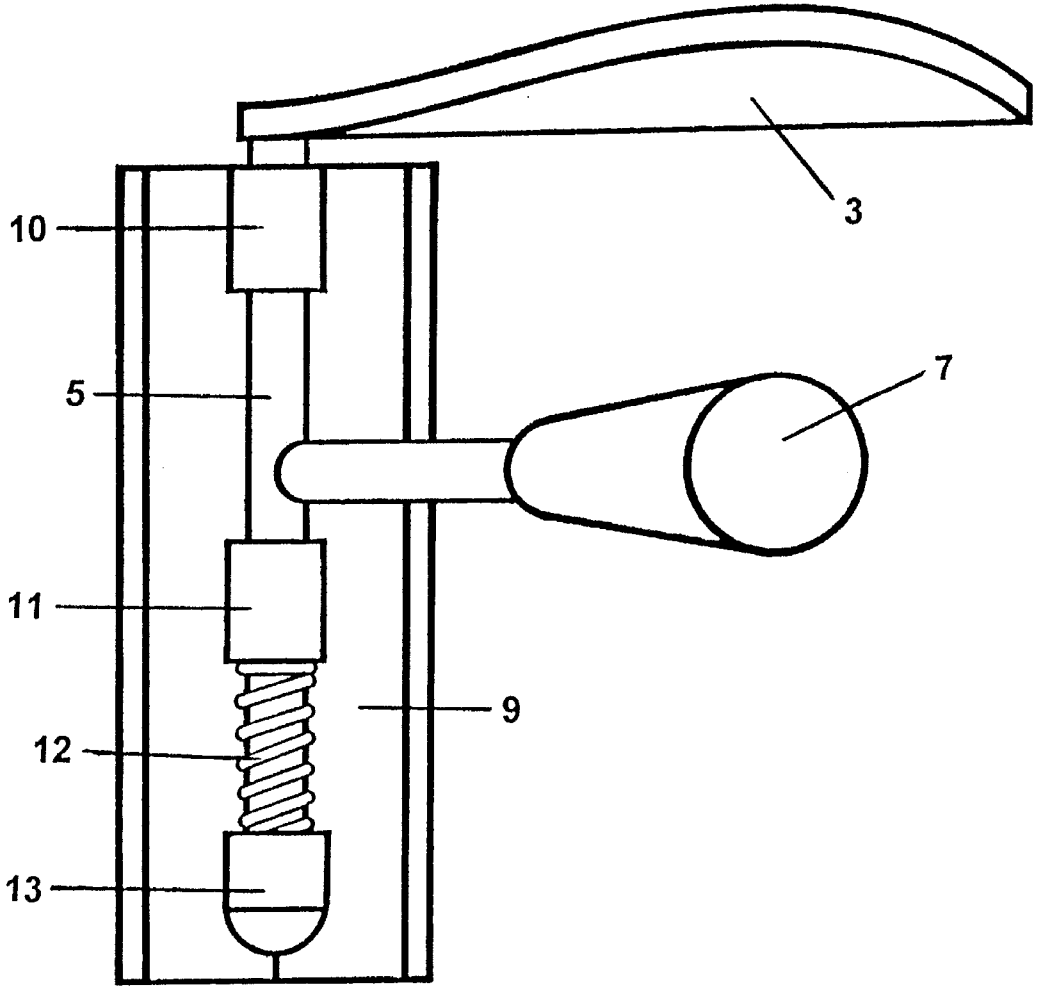
FIG. 4 shows a diagram of an embodiment of the interior workings of the pivoting and clamping mechanism, with housing, knob and pivoting support ear.

FIG. 4 shows a diagram of an embodiment of the pivoting rod assembly 5 with knob 7 set into an upper guide bushing 10 and a lower guide bushing 11 which are permanently attached to the pivot rod housing 9. A rod bushing 13 is permanently attached to the pivoting rod assembly 5 and compresses a spring 12 against the lower guide bushing 11. The pressure exerted by the spring 12 as it is compressed causes the clamping effect of the pivoting rod assembly 5 and the attached pivoting support ear 3.

Figure 5:
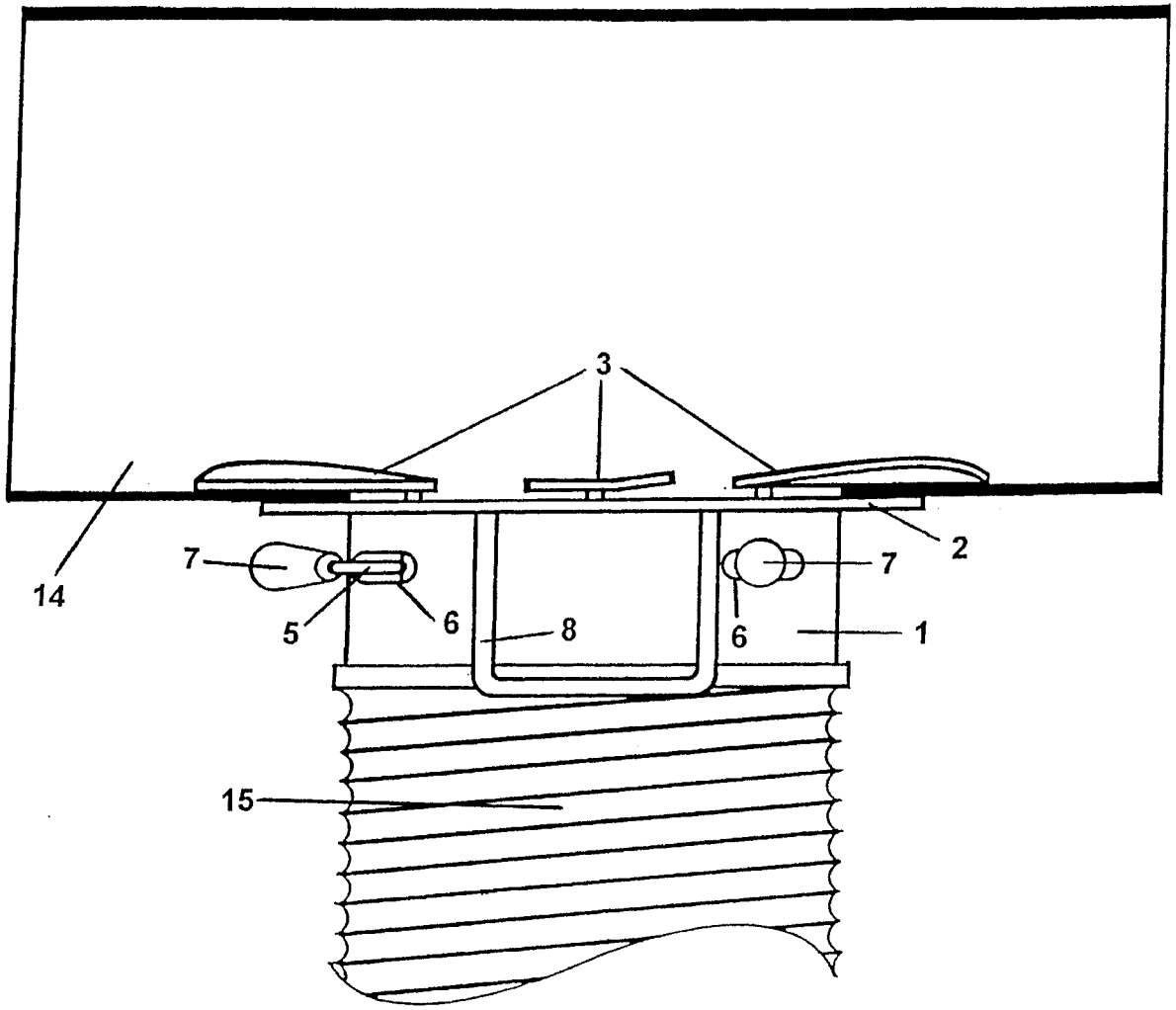
FIG. 5 shows an embodiment of the present invention clamped to ductwork with a large diameter vacuum hose secured to the hose attachment tube.

FIG. 5 shows a cutaway view of a piece of ductwork 14 to which an embodiment of the present invention has been clamped. A piece of large diameter vacuum hose 15 is shown secured to the hose attachment tube 1. The pivoting support ears 3, pivoting rod assemblies 5 and knobs 7 are set in the clamping position. Because the pivoting support ears 3 have a low profile inside the ductwork 14, they cause minimal disruption of the smooth flow of air from the ductwork 14 to the large diameter vacuum hose 15.

The present invention can be built in various different diameters to accommodate vacuum hoses of different sizes.

My invention has been thoroughly tested and found to be completely satisfactory for the accomplishment of the above objects.

Having illustrated and described the principles of my invention in a preferred embodiment and variations thereof, it should be apparent to those skilled in the art that the invention may be modified in arrangement and detail without departing from the principles thereof. I claim as my invention all modifications coming within the scope and spirit of the following claims.

I claim:

1. Apparatus for cleaning ductwork comprising:

a hose attachment tube body for receiving a hose at one end and including a flat flange attached at the other end, said flat flange adapted to abut against the surface of the ductwork around a hole in the ductwork, means for temporarily and removably connecting said hose attachment tube body flange to said surface over the hole therein including;

at least one pivoting rod assembly attached to the interior of said hose attachment tube body, said pivoting rod assembly comprising support ear means, a rod, rod bushings, a compression spring and means extending to the exterior of said hose attachment tube body for manipulating said pivoting rod assembly; said rod being supported by said rod bushings for movement relative thereto, said support ear means connected to one end of said rod and said compression spring arranged to resist axial movement of said rod in a direction toward said other end;

said support ear means engaging the interior of the ductwork adjacent the hole therein when said flat flange is in abutting engagement with said surface over the hole therein and said pivoting rod assembly is manipulated by said means extending to the exterior to move said support ear means through the hole and into engagement with the interior wall adjacent the hole with the wall of the ductwork being thereby clamped between said flat flange and said support ear means by the pressure exerted by said compression spring.

2. The means of claim 1 comprising at least one handle attached to the exterior of said hose attachment tube.

* * * * *